United States Patent [19]

Kirisawa et al.

[11] 4,444,169

[45] Apr. 24, 1984

[54] AIR-FUEL RATIO CONTROLLING DEVICE FOR INTERNAL COMBUSTION ENGINES

[75] Inventors: Tadashi Kirisawa; Teruo Yamauchi; Yoshishige Oyama, all of Katsuta, Japan

[73] Assignee: Hitachi, Ltd., Tokyo, Japan

[21] Appl. No.: 439,300

[22] Filed: Nov. 4, 1982

[30] Foreign Application Priority Data

Nov. 11, 1981 [JP] Japan ..... 56-179766

[51] Int. Cl.[3] ..... F02M 7/10

[52] U.S. Cl. ..... 123/344; 123/494

[58] Field of Search ..... 123/344, 340, 414, 419, 123/425, 494; 73/23.1, 35; 364/431.05

[56] References Cited

U.S. PATENT DOCUMENTS

| | | | |
|---|---|---|---|
| 4,381,748 | 5/1983 | Eckert et al. | 123/494 |
| 4,391,248 | 7/1983 | Latsch | 123/425 |
| 4,393,687 | 7/1983 | Müller et al. | 73/35 |
| 4,397,283 | 8/1983 | Komaroff et al. | 73/35 |

*Primary Examiner*—William A. Cuchlinski, Jr.
*Attorney, Agent, or Firm*—Antonelli, Terry & Wands

[57] ABSTRACT

An air-fuel ratio controlling device for internal combustion engines, having a detector for a flow rate of the air supplied into a cylinder, a means for detecting a ratio of a flow rate of the air supplied into the cylinder to that of a fuel supplied thereinto, a control means for setting an air-fuel ratio to an optimum level on the basis of output signals from the air-fuel ratio detecting means and air flow rate detector, and a means for controlling the supplying of the fuel into the cylinder in accordance with an output signal from the air-fuel ratio control means. The air-fuel ratio detecting means has members for detecting the light generated by a flame in the cylinder and having at least two special wavelengths. The combustion condition corresponding to an air-fuel ratio in the cylinder is detected by the light-detecting members, and a signal representative of an actual air-fuel ratio is generated on the basis of outputs therefrom.

7 Claims, 8 Drawing Figures

AIR-FUEL RATIO CONTROLLING DEVICE FOR INTERNAL COMBUSTION ENGINES

BACKGROUND OF THE INVENTION

This invention relates to an air-fuel ratio controlling device for internal combustion engines, and more particularly to an air-fuel ratio controlling device for internal combustion engines, which is adapted to detect the combustion condition in a cylinder, feed back a signal representative of the mentioned combustion condition, and control in accordance with the signal an air-fuel ratio in a gaseous mixture to be supplied to the cylinder.

In a conventional air-fuel ratio controlling device for internal combustion engines, a zirconia-oxygen sensor is widely used as an air-fuel ratio sensor. An output signal from this sensor is fed back to control a ratio of the air to fuel (air-fuel ratio) in a gaseous mixture, which is supplied to a cylinder in an internal combustion engine through a carburetor or a fuel injector, in such a manner that the air-fuel ratio is kept close to a theoretical value. This zirconia-oxygen sensor is provided in an exhaust pipe-gathering section, or a section on the downstream side of the exhaust pipe-gathering section, of the internal combustion engine, and adapted to detect a concentration of the oxygen in an exhaust gas, which occurs after the gaseous mixture is burnt, and thereby determine the suitableness of the air-fuel gaseous mixture. However, since the gaseous mixture, an air-fuel ratio in which is to be controlled, flows in a passage extending from the cylinder to the exhaust pipe, the response time for the controlling of an air fuel ratio becomes long. Accordingly, it is very difficult to control an air-fuel ratio accurately, especially, when a load is changed suddenly.

The zirconia-oxygen sensor is not sufficiently operated at a low temperature, so that it cannot be used to control an air-fuel ratio when starting an engine. Moreover, an output from the zirconia-oxygen sensor greatly varies with respect to a special air-fuel ratio (for example, a theoretical air-fuel ratio) but it is difficult to obtain such outputs therefrom that vary linearly in their levels with respect to air-fuel ratios in a wide range.

SUMMARY OF THE INVENTION

An object of the present invention is to provide an air-fuel ratio controlling device for internal combustion engines, which is free from the above-mentioned drawbacks encountered in a conventional air-fuel ratio controlling device of this kind.

The characteristics of the air-fuel ratio controlling device for internal combustion engines according to the present invention reside in that an air-fuel ratio is determined by detecting the light generated by the flame in a cylinder.

DESCRIPTION OF THE PREFERRED EMBODIMENT

Before an embodiment of an air-fuel ratio controlling device for internal combustion engines according to the present invention has been shown, the principle of the invention will be briefly described. In an internal combustion engine, a fuel is usually mixed with the air, which has passed through an air cleaner, at a predetermined ratio by, for example, a fuel injector or a carburetor. This air-fuel gaseous mixture is sucked into a cylinder in an engine, and compressed by a piston to be ignited. At this time, the combustion condition in the cylinder varies in accordance with an air-fuel ratio in the gaseous mixture sucked thereinto. Especially, the color of the light from a flame in a combustion chamber varies in accordance with an air-fuel ratio. Namely, when an air-fuel ratio is high (the air is rich), the yellowish light is generated; when an air-fuel ratio is low (the air is lean), the bluish white light is generated.

Figure 1:
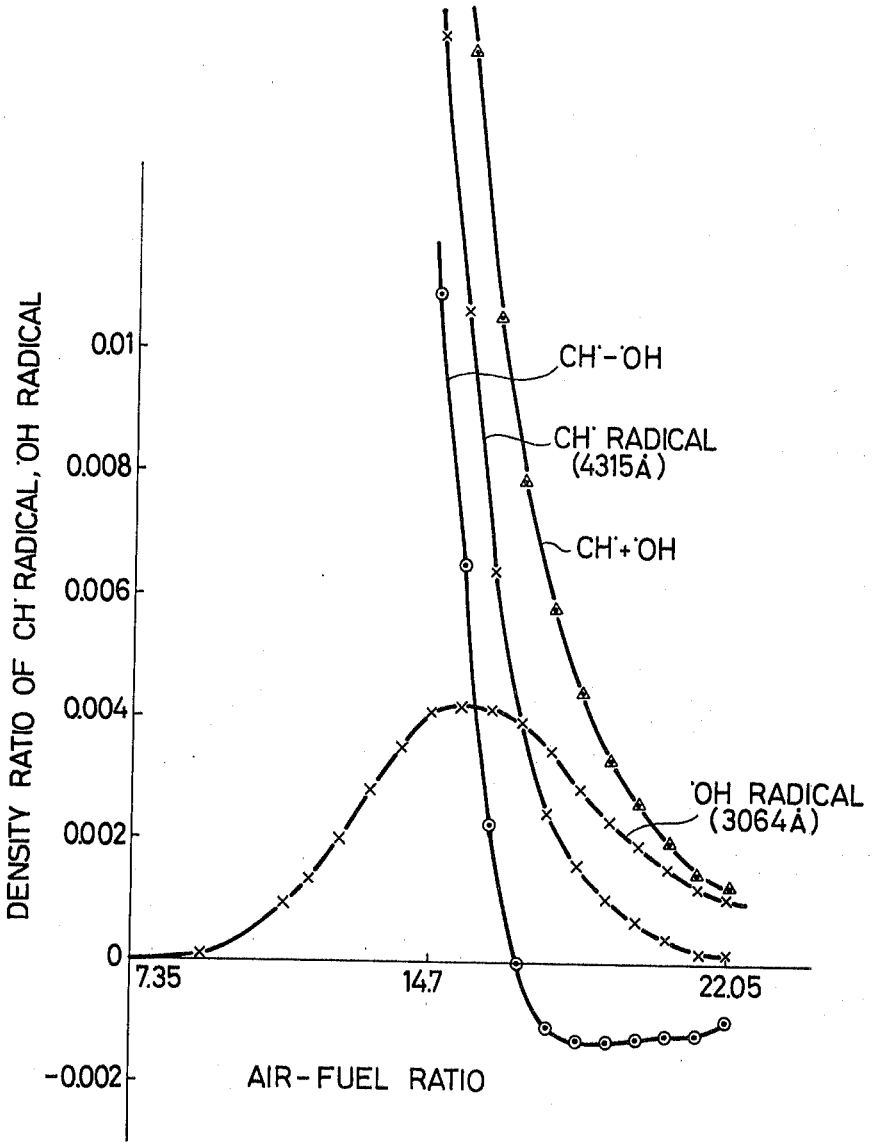
FIG. 1 is a graph showing the relation between air-fuel ratios and concentrations of OH radical and CH radical.

The reason why such a phenomena occur is that a ratio of a concentration of intermediate combustion products, i.e. CH radical and OH radical in the flame to that of the other chemical components therein varies in accordance with variations in an air-fuel ratio as shown in FIG. 1. These intermediate combustion products, CH radical and OH radical, have spectra of intrinsic wavelengths. Namely, the CH radical has a spectrum of 4315Å, and the OH radical a spectrum of 3064Å. Therefore, when a ratio of the concentration of CH radical to that of OH radical in the combustion flame, i.e. the color of the flame is detected, the air-fuel ratio of the gaseous mixture can be accurately determined.

In an embodiment, which will now be described, of the present invention, the spectra having intrinsic wavelengths of CH radical and OH radical in the light emitted from a flame are measured in order to determine the color of the flame.

Figure 2:
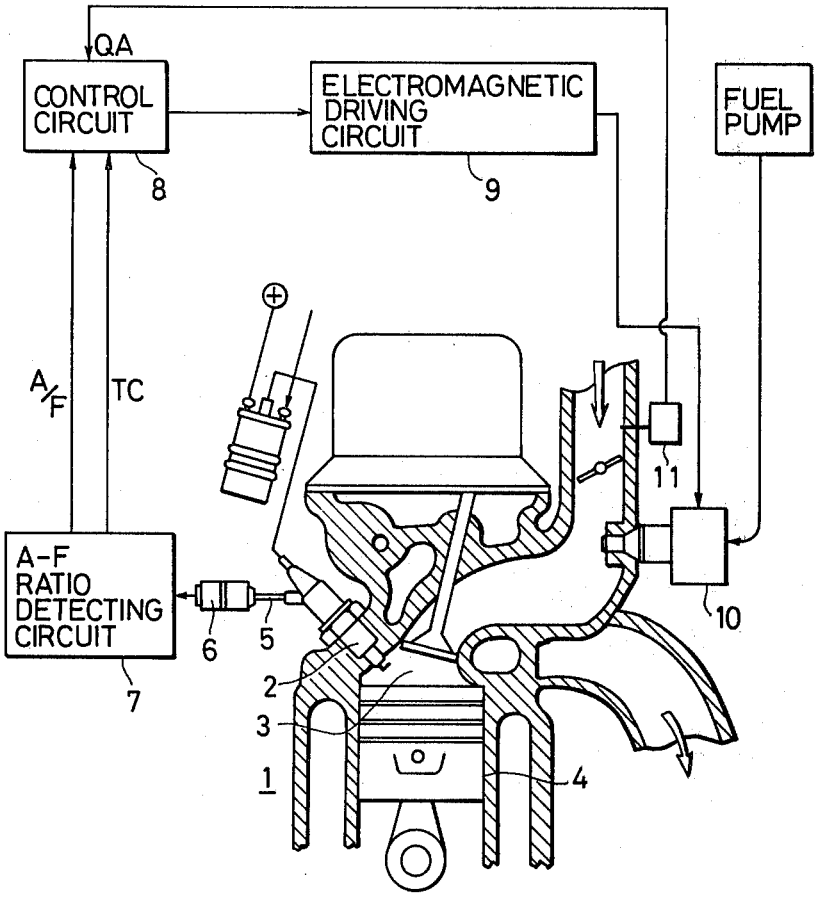
FIG. 2 is a block diagram showing the construction of an air-fuel ratio controlling device as a whole according to the present invention.

FIG. 2 is a block diagram of an air-fuel ratio controlling device for internal combustion engines according to the present invention. A window, which is not clearly seen from the drawing, for use in introducing the light, which generated by a flame in a combustion chamber 3, to the outside of a cylinder 4, is provided in an ignition plug 2 in an engine 1. The light is passed through an optical fiber 5 to be introduced into a photoelectric converter 6, which is adapted to convert the light into an electric signal. An electric signal representative of the light from the flame and outputted from the photoelectric converter 6 is inputted into an air-fuel ratio detecting circuit 7. The air-fuel ratio detecting circuit 7 is adapted to process in a predetermined manner the electric signal received from the photoelectric converter 6, and then generate a signal representative of an air-fuel ratio A/F, and as necessary a signal representative of a combustion temperature Tc. A control circuit 8 consisting of, for example, a micro-computer is adapted to receive a signal from the air-fuel ratio detecting circuit 7 as well as a signal representative of a flow rate QA of the suction air detected by an air flow rate detector 11, carry out computation in a predetermined manner, and output to an electromagnetic driving circuit 9 a control signal for controlling an air-fuel ratio to a suitable level. This electromagnetic driving circuit 9 is adapted to control an injector 10, from which a fuel is injected in accordance with a control signal, or an electromagnetic valve (not shown) provided in a carburetor, and thereby properly regulate an air-fuel ratio of a gaseous mixture, the electromagnetic driving circuit 9 utilizing a generally known circuit.

Figure 3:
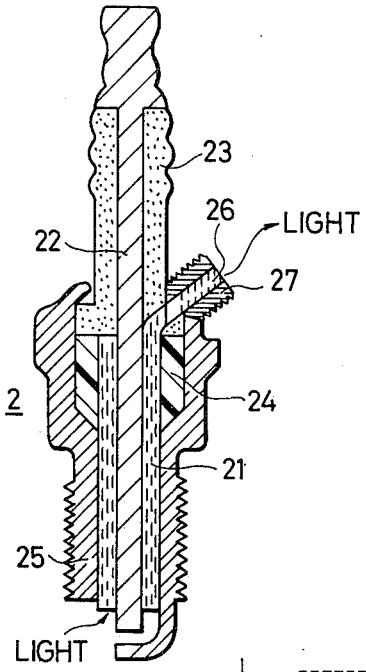
FIG. 3 is a sectional view illustrating the details of a lighting ignition plug 2.

FIG. 3 shows the details of the lighting ignition plug 2 shown in FIG. 2. A lighting member 21 consisting of quartz or rock crystal, which has a high transmissivity, is provided at its axial portion with a bore, through which a central electrode 22 is inserted. These lighting member 21 and central electrode 22 are fixed to a plug body 25 by a ceramic insulator 23 and a filler member 24 consisting of a resin.

The lighting member 21 consisting of quartz rock crystal is provided with a projecting portion 26 at an upper portion thereof. The light from a combustion flame, which is captured by the lighting member 21, passes through the projecting portion 26 and optical fiber 5 to be introduced into the photoelectric converter 6 shown in FIG. 2. Reference numeral 27 denotes a plug body for retaining the projecting portion 26 of the lighting member 21, which plug body 27 is adapted to be connected to a fiber cable.

The temperature of the portion of an ignition plug which is in the vicinity of a spark gap generally increases to 600°–800° C. due to sparks and the combustion of a gaseous mixture. Since the melting point of, for exmaple, quartz is 1600° C., the lighting member 21 consisting of quartz or rock crystal is not deteriorated by such heat. It is preferable that the lighting member 21 be positioned in such a manner that a lighting portion, i.e. a lower end surface, of the lighting member 21 is spaced from the spark gap at several millimeters in order to prevent the dirt, such as carbon generated due to sparks and combustion of a gaseous mixture from being accumulated thereon.

Figure 4:
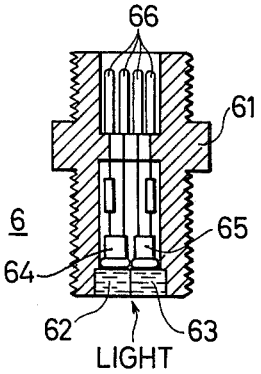
FIG. 4 is a sectional view illustrating the details of a photoelectric converter 6.

FIG. 4 shows the details of the photoelectric converter 6 shown in FIG. 2. Colored filters 62, 63 (another colored filter is not shown in the drawing) are set in a lower end surface of a plug body 61, and photosensitive diodes 64, 65 are provided on the rear side of the colored filters 62, 63, respectively (a photosensitive diode (not shown) is also provided on the rear side of another colored filter (not shown) referred to above). Therefore, the light captured by the lighting member 21 shown in FIG. 3 and introduced into the optical fiber 5 via the projecting portion 26 is applied to the photosensitive diodes 64, 65 through the colored filters 62, 63. The light is, of course, applied to another photosensitive diode (not shown) at well through the relative colored filter (not shown). Referring to the drawing, reference numeral 66 denotes electrode terminals of the photosensitive diodes.

Figure 5:
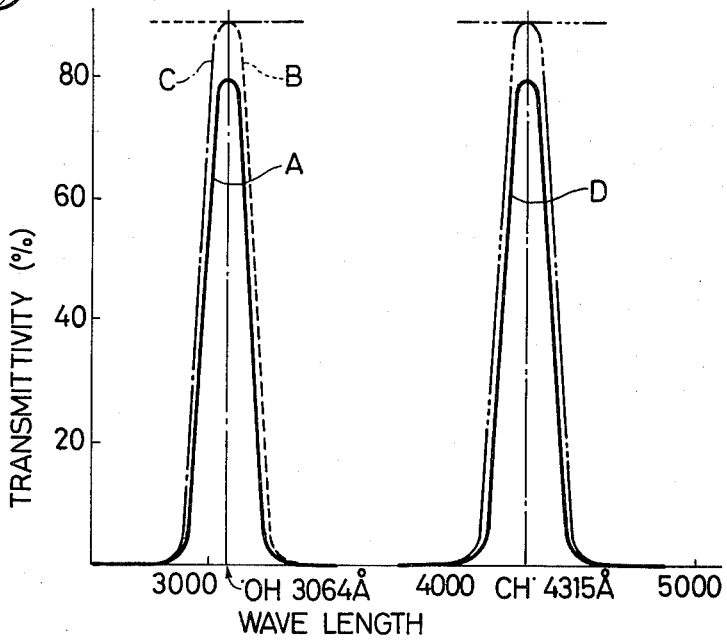
FIG. 5 is a graph showing the transmission characteristics of a colored filter.

FIG. 5 is a graph showing the transmission characteristics of the colored filters 62, 63 shown in FIG. 4. The transmission characteristics of the colored filter 62 capable of passing therethrough only the light having a wavelength in the vicinity of a special wavelength (3064Å) are shown in thick line A in the left-hand portion of the graph. The transmission characteristics A of such a filter can be obtained by laminating a high-pass out filter (the transmission characteristics of which are shown in broken line B), which is capable of not passing therethrough the light having a wavelength of not less than, but passing therethrough only the light having a wavelength of not more than, for example, 3064Å as shown in the drawing, and a low-pass cut filter capable of passing therethrough only the light having a wavelength of not less than 3064Å. The other colored filter 63 can also be obtained by laminating a high-pass cut filter and a low-pass cut filter in the same manner as in case of the colored filter 62. The filter 63 is capable of passing therethrough only the light having a wavelength in the vicinity of 4315Å, as shown in a thick line D. A colored filter not shown in the drawing consists of a low-pass cut filter capable of passing only the light having a wavelength of not less than about 8000Å.

As is clear from the above description, the light having wavelengths of 3064Å, 4315Å, i.e. the light corresponding to the amounts of OH radical and CH radical, which are intermediate combustion products in a flame, is applied to the photosensitive diodes 64, 65 in the photoelectric converter 6. The light having a wavelength of about not less than about 8000Å, i.e. the light, the illuminance of which is proportional to the combustion temperature of a flame, is to be applied to another photosensitive diode, which is not shown in the drawings.

As described above, the present invention uses a plurality of photosensitive diodes to detect an air-fuel ratio of a gaseous mixture and a combustion temperature, feed back signals representative of the air-fuel ratio and combustion temperature, and thereby control a fuel injection rate accurately. An electric circuit using such photosensitive diodes to detect an air-fuel ratio and a combustion temperature will be described.

Figure 6:
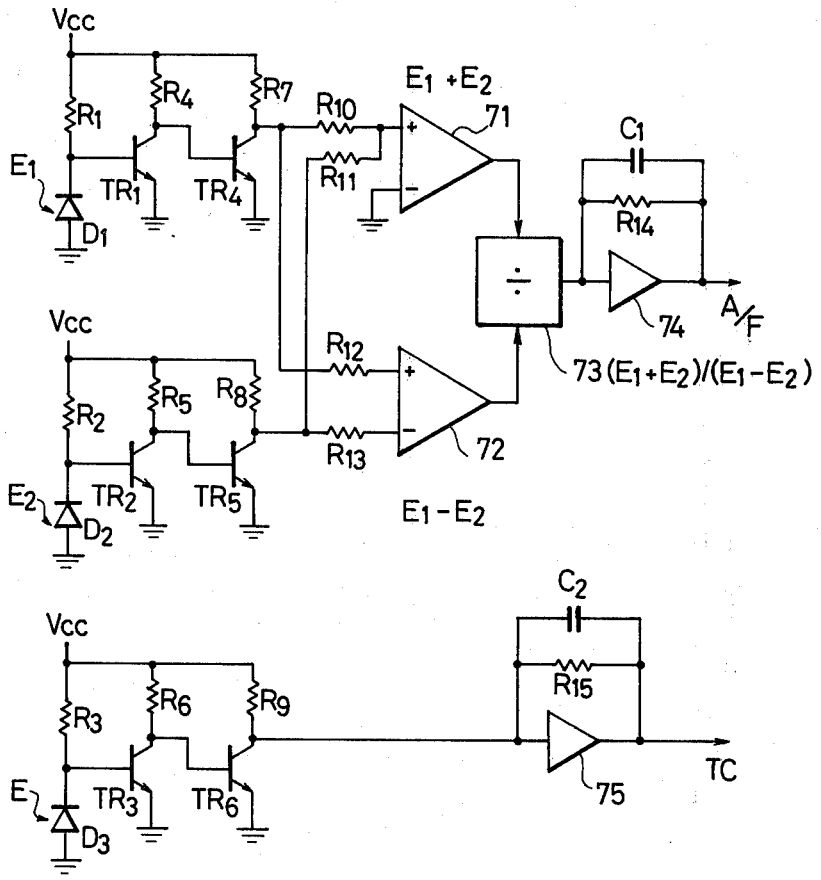
FIG. 6 is a circuit diagram showing the detailes of an air-fuel ratio detecting circuit 7.

FIG. 6 shows the details of the air-fuel ratio detecting circuit 7 shown in FIG. 2, which circuit includes the photosensitive diodes shown in FIG. 4. Referring to the drawing, photosensitive diodes $D_1$, $D_2$, $D_3$ are series-connected to resistors $R_1$, $R_2$, $R_3$, respectively, in the reverse direction, and power source voltages Vcc are applied to these series-connected circuits. The plates of the photosensitive diodes $D_1$, $D_2$, $D_3$ are connected to the bases of transistors $TR_1$, $TR_2$, $TR_3$. The plates of the transistors $TR_1$, $TR_2$, $TR_3$ are connected to the power source voltages Vcc through resistors $R_4$, $R_5$, $R_6$, and the emitters thereof are grounded. The collectors of these transistors $TR_1$, $TR_2$, $TR_3$ are connected to the bases of transistors $TR_4$, $TR_5$, $TR_6$. The emitters of the transistors $TR_4$, $TR_5$, $TR_6$ are grounded, and the collectors thereof are connected to the power source voltages through resistors $R_7$, $R_8$, $R_9$.

The transistor circuits described above are adapted to amplify the electric currents flowing through the photosensitive diodes $D_1$, $D_2$, $D_3$, i.e. the electric currents varying in accordance with the quantities of the light applied thereto. Voltages in accordance with the quantities of the light applied to the photosensitive diodes $D_1$, $D_2$, $D_3$ are generated in the collectors of the transistors $TR_4$, $TR_5$, $TR_6$ in the later stages.

The light $E_1$ having a wavelength of 3064Å and passing through the above-mentioned filter is applied to the photosensitive diode $D_1$, and the light $E_2$ having a wavelength of 4315Å to the photosensitive diode $D_2$. The light E having a wavelength of not less than 8000Å is applied to the photosensitive diode $D_3$.

The signals generated in the collectors of the transistors $TR_4$, $TR_5$ are applied to a positive terminal of an adder 71 through input resistors $R_{10}$, $R_{11}$. These collector signals are also applied to positive and negative terminals of a subtractor 72 through input resistors $R_{12}$, $R_{13}$. Accordingly, an output signal from the adder 71 represents the sum of the light having a wavelength of 3064Å and the light having a wavelength of 4315Å, i.e. the sum of a OH component and a CH component, while an output from the subtractor 72 represents the difference therebetween.

The outputs from the adder 71 and subtractor 72 are applied to a divider 73 to conduct division in accordance with the following equation, $$VA/F=(E_1+E_2)/(E_1-E_2) \quad (1)$$

wherein VA/F represents an output signal from the divider 73. This output signal VA/F is amplified by an amplifier consisting of an operation amplifier 74, a capacitor $C_1$ and a resistor $R_{14}$ to be outputted to the control circuit 8 shown in FIG. 2. On the other hand, a signal generated in the collector of the transistor $TR_6$ is amplified by an amplifier consisting of an operation amplifier 75, a capacitor $C_2$ and a resistor $R_{15}$ to be also outputted to the control circuit 8.

Figure 7:
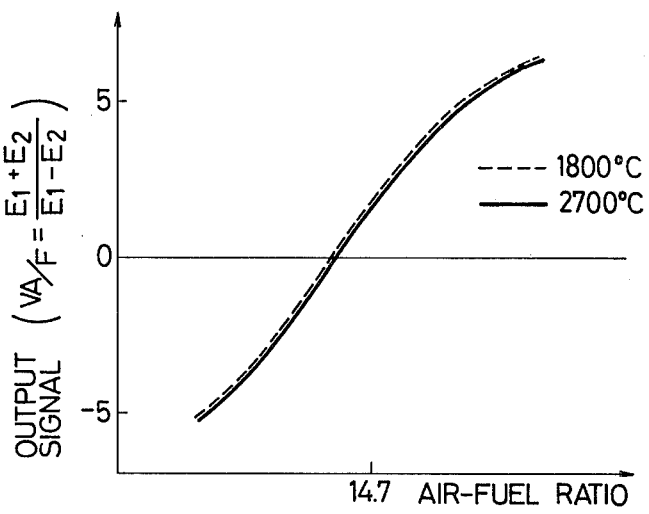
FIGS. 7 and 8 are graphs showing the output characteristics of the air-fuel ratio detecting circuit.

The output characteristics of the air-fuel ratio detecting circuit 7 described above are shown in FIG. 7. In the drawing, the axis of abscissas represents an air-fuel ratio, and the axis of ordinates an output signal, $VA/F=(E_1+E_2)/(E_1-E_2)$ shown in the equation (1).

Figure 8:
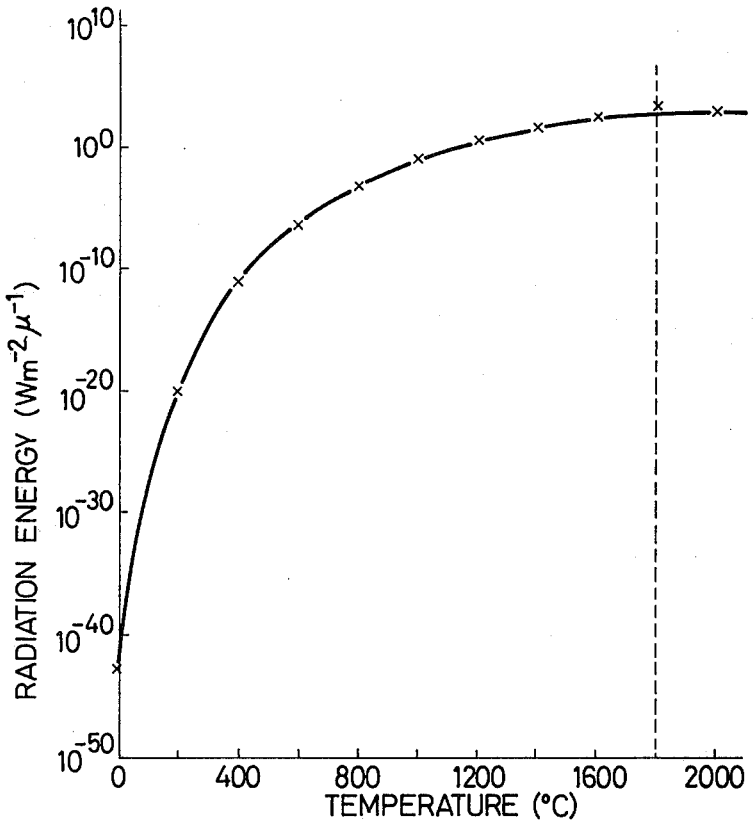

The quantity of the light generated in a combustion flame in a cylinder genrally corresponds to a temperature in the cylinder, and varies in accordance with the Planck's law of radiation. FIG. 8 shows this fact; the broken line in the graph indicates the radiation energy, i.e. the output signal E in the case where a temperature T in the cylinder is 1800° C. Accordingly, an output signal from the photosensitive diode $D_3$ (shown in FIG. 6), to which the light having a wavelength of not less than about 8000Å is applied, represents a combustion temperature Tc in the cylinder.

Returning to FIG. 7, an output signal VA/F from the air-fuel ratio detecting circuit 7 represents as shown in the equation (1) a ratio of a signal representative of the sum of the radiation energy $E_1$, $E_2$ to a signal representative of the difference therebetween. Therefore, as shown in the graph, an output signal from the circuit 7 substantially corresponds to an air-fuel ratio and varies in a wide range irrespective of variations in a combustion temperature T in the cylinder.

According to the present invention, output signals, the levels of which vary linearly in a wide range with respect to air-fuel ratios in a cylinder can be obtained by detecting the light generated by a combustion flame in the cylinder, and a feed-back type air-fuel ratio control device capable of controlling the injection of a fuel accurately without delay can be thereby provided.

According to an embodiment of the present invention, which employs a lighting member 21 unitarily formed with an ignition plug 2, the air-fuel ratio controlling device can be applied as it is to a conventional engine without forming a light-receiving member additionally in a cylinder 4.

Although the above embodiment of the present invention has been described with reference to a fuel injector type engine, the present invention can, of course, be applied easily to a carburetor type engine as well.

What is claimed is:

1. An air-fuel ratio controlling device for internal combustion engines, comprising a means for detecting a flow rate of the air supplied into a cylinder in an internal combustion engine, a means for detecting an air-fuel ratio of a gaseous mixture supplied into said cylinder, a control means for setting the air-fuel ratio to an optimum level on the basis of output signals from said air flow rate detecting means and said air-fuel ratio detecting means, and a means for controlling the supplying of the fuel into said cylinder, in accordance with an output signal from said control means in such a manner that the air-fuel ratio is in an optimum level, said air-fuel ratio detecting means consisting of a means for detecting the light generated by a flame in a combustion chamber, to determine the combustion condition, which corresponds to an actual air-fuel ratio, in said cylinder.

2. An air-fuel ratio controlling device for internal combustion engines according to claim 1, wherein said air-fuel ratio detecting means consists of a member for guiding the light generated by a flame in said combustion chamber, a filter unit for passing therethrough components of special wavelengths of the light introduced thereinto by said light-guiding member, photosensitive elements adapted to receive said components of the light passing through said filter unit and generate output signals, and a member adapted to generate an output signal representative of the combustion condition on the basis of the output signals from said photosensitive elements.

3. An air-fuel ratio controlling device for internal combustion engines according to claim 2, wherein said light-guiding member includes a window formed in a plug.

4. An air-fuel ratio controlling device for internal combustion engines according to claim 2, wherein said filter unit includes at least two filters capable of passing therethrough the light having different, special wavelengths.

5. An air-fuel ratio controlling device for internal combustion engines according to claim 4, wherein said photosensitive elements are disposed in opposition to said filters and adapted to generate electric signals, the levels of which correspond to the illuminance of the light passing through said filters.

6. An air-fuel ratio controlling device for internal combustion engines according to claim 4, wherein said device further includes a means for generating a signal, the level of which corresponds to a ratio of the sum of said two electric signals to the difference therebetween.

7. An air-fuel ratio controlling device for internal combustion engines according to claim 3, wherein said window is formed so as to surround a central electrode of said plug.

* * * * *